US009027373B2

(12) United States Patent
Zuraski et al.

(10) Patent No.: US 9,027,373 B2
(45) Date of Patent: May 12, 2015

(54) HYBRID LOCK CYLINDER

(71) Applicant: Schlage Lock Company LLC, Indianapolis, IN (US)

(72) Inventors: Robert D. Zuraski, Taunton, MA (US); Mary Teresa Carter, Boston, MA (US); Daniel Hugh Kindstrand, Plainville, MA (US); David Bruce Miller, Braintree, MA (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

(21) Appl. No.: 13/963,995

(22) Filed: Aug. 9, 2013

(65) Prior Publication Data

US 2014/0041427 A1 Feb. 13, 2014

Related U.S. Application Data

(60) Provisional application No. 61/681,541, filed on Aug. 9, 2012.

(51) Int. Cl.
*E05B 29/04* (2006.01)
*E05B 29/00* (2006.01)

(52) U.S. Cl.
CPC ..... *E05B 29/0033* (2013.01); *E05B 29/0013* (2013.01); *E05B 29/0066* (2013.01)

(58) Field of Classification Search
CPC ... E05B 29/00; E05B 29/0066; E05B 29/004; E05B 29/0013; E05B 21/063
USPC ..... 70/358, 419, 421, 365, 366, 492, 495
See application file for complete search history.

(56) References Cited

U.S. PATENT DOCUMENTS

| | | | | |
|---|---|---|---|---|
| 2,155,440 | A | 4/1939 | Olson | |
| 2,358,164 | A | 9/1944 | Honger | |
| 2,524,339 | A | 10/1950 | Young et al. | |
| 2,587,739 | A | 3/1952 | Kunz | |
| 3,260,080 | A | 7/1966 | Wellekens | |
| 3,509,749 | A | 5/1970 | Regan et al. | |
| 4,267,717 | A | 5/1981 | Martikainen | |
| 4,512,166 | A | 4/1985 | Dunphy et al. | |
| 4,667,493 | A | 5/1987 | Takahashi | |
| 4,796,447 | A * | 1/1989 | Rabinow | 70/495 |
| 4,961,333 | A * | 10/1990 | Rabinow | 70/495 |

(Continued)

FOREIGN PATENT DOCUMENTS

| | | |
|---|---|---|
| EP | 0212468 | 8/1986 |
| EP | 0712979 A1 | 5/1996 |

(Continued)

OTHER PUBLICATIONS

International Search Report for PCT/US2013/054431 dated Jan. 16, 2014; International Searching Authority (2 pages).

(Continued)

*Primary Examiner* — Lloyd Gall
(74) *Attorney, Agent, or Firm* — Krieg DeVault LLP

(57) ABSTRACT

The present disclosure provides for a lock cylinder having a rotatable spindle with at least one disc and at least one wafer housing rotatingly engaged therewith. A slidable wafer is carried on the wafer housing. A locking bar is operable to prevent rotation of the lock cylinder in a locked position and permit rotation of the lock cylinder in an unlocked position.

26 Claims, 7 Drawing Sheets

(56) References Cited

U.S. PATENT DOCUMENTS

| | | | | |
|---|---|---|---|---|
| 5,544,509 | A | 8/1996 | Mielonen | |
| 6,058,751 | A * | 5/2000 | Dimig et al. | 70/419 |
| 6,584,819 | B1 | 7/2003 | Hung | |
| 7,530,246 | B2 | 5/2009 | Yang | |
| 7,665,333 | B2 | 2/2010 | Shabtay et al. | |
| 7,980,105 | B2 | 7/2011 | Yang | |
| 8,074,480 | B2 | 12/2011 | Huang | |
| 8,091,393 | B2 | 1/2012 | Damikolas et al. | |
| 8,117,876 | B2 | 2/2012 | Mathachan | |
| 8,347,678 | B2 | 1/2013 | Chong | |
| 8,424,349 | B2 | 4/2013 | Marcelle et al. | |
| 2003/0019263 | A1 | 1/2003 | Chen | |
| 2005/0061042 | A1 | 3/2005 | Lin | |
| 2006/0048554 | A1 | 3/2006 | Keller | |
| 2008/0022734 | A1 | 1/2008 | McDaid et al. | |
| 2010/0050718 | A1 | 3/2010 | Boesel et al. | |
| 2011/0265526 | A1 | 11/2011 | Zuraski | |
| 2013/0067972 | A1 | 3/2013 | Buhl | |

FOREIGN PATENT DOCUMENTS

| | | |
|---|---|---|
| EP | 2085542 | 1/2009 |
| EP | 2360333 | 2/2011 |
| JP | 2007-278016 A | 10/2007 |

OTHER PUBLICATIONS

Written Opinion of the International Searching Authority for PCT/US2013/054431 dated Jan. 16, 2014; International Searching Authority (4 pages).

* cited by examiner

HYBRID LOCK CYLINDER

CROSS REFERENCE TO RELATED APPLICATIONS

The present application claims the benefit of U.S. Provisional Patent Application No. 61/681,541 filed Aug. 9, 2012, and is incorporated herein by reference.

TECHNICAL FIELD

The present invention relates to a hybrid lock cylinder and more particularly to a lock cylinder having one or more sliding wafers and rotatable discs that are actuated by a single key.

BACKGROUND

Present approaches to some lock cylinder designs suffer from a variety of drawbacks, limitations, disadvantages and problems including the ability to be opened with known lock picking techniques. There is a need for the unique and inventive lock cylinder of the present disclosure to limit such lock picking techniques.

SUMMARY

One embodiment of the present disclosure is a unique lock cylinder configuration with a plurality of sliding and rotating lock mechanisms. Other embodiments include apparatuses, systems, devices, hardware, methods, and combinations for the same. Further embodiments, forms, features, aspects, benefits, and advantages of the present application shall become apparent from the description and figures provided herewith.

BRIEF DESCRIPTION OF THE FIGURES

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
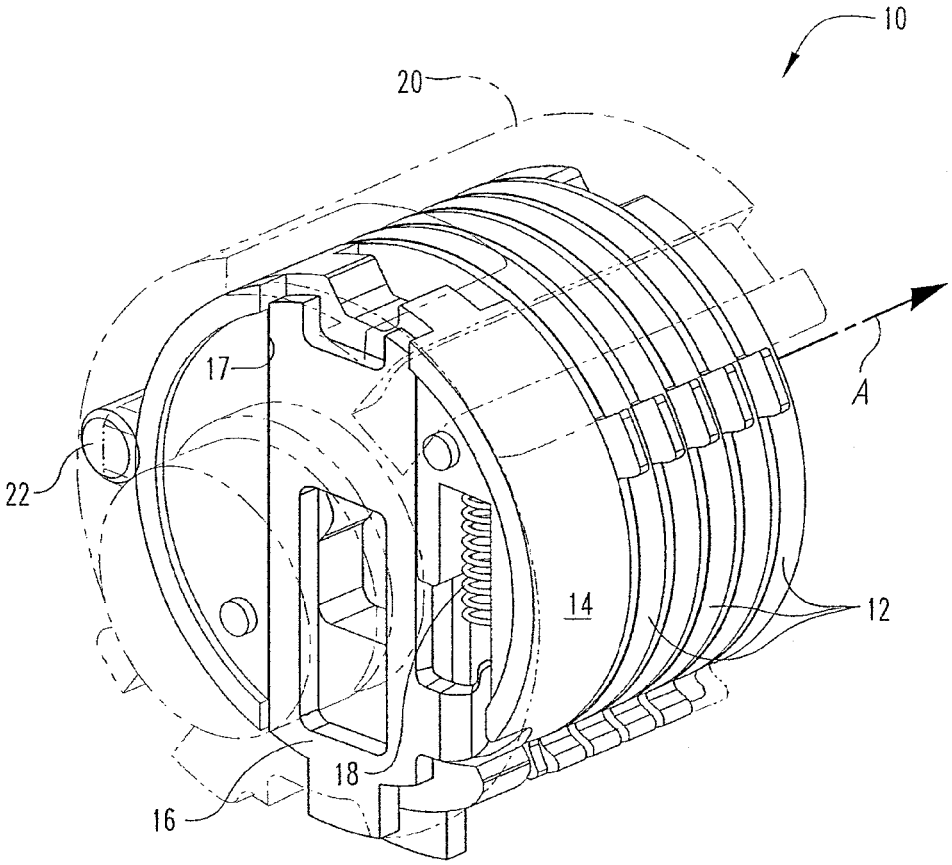
FIG. 1 is a perspective view of a lock cylinder according to one embodiment of the present disclosure.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 illustrates a hybrid lock cylinder assembly 10 according to one embodiment of the present disclosure. The hybrid lock cylinder assembly 10 includes one or more discs 12 and one or more rotatable wafer housings 14 rotationally coupled with a spindle 20. One or more wafers 16 are slidingly coupled to each wafer housing 14 and are configured to selectively lock the wafer housing 14 to the spindle 20 and in some embodiments the wafers can couple to an external support structure (not shown). A biasing member 18 such as a coil spring can be operably coupled between the wafer housing 14 and the wafer 16 to urge the wafer 16 toward a desired position within a wafer channel 17 formed in the wafer housing 14. The biasing member 18 can engage with an arm 44 (see FIG. 2) projecting from the wafer 16. The spindle 20 can be positioned around the discs 12 and the wafer housing 14 to form an outer shell or housing that can be locked and unlocked with the wafer housing 14 and an outer structural support (not shown). By way of example and not limitation, the support structure can a separate housing or the like. A locking bar 22 is operationally coupled with the spindle 20 to lock the spindle 20 relative to a support structure in a first position and lock the spindle to the wafer housing 14 and discs 12 in a second position. The one or more discs 12 and wafer housing 14 along with the spindle 20 can be rotated about a common axis A via a key or the like when the locking bar 22 is in the second position. Material selection for the various components of the hybrid lock cylinder 10 can include metals, metal alloys, plastics, composites, ceramics or combinations thereof. Furthermore various material coatings can be used to reduce wear, reduce corrosion, increase lubricity of moving contact surfaces or otherwise as may be desirable for the components of the hybrid lock cylinder 10.

Figure 2:
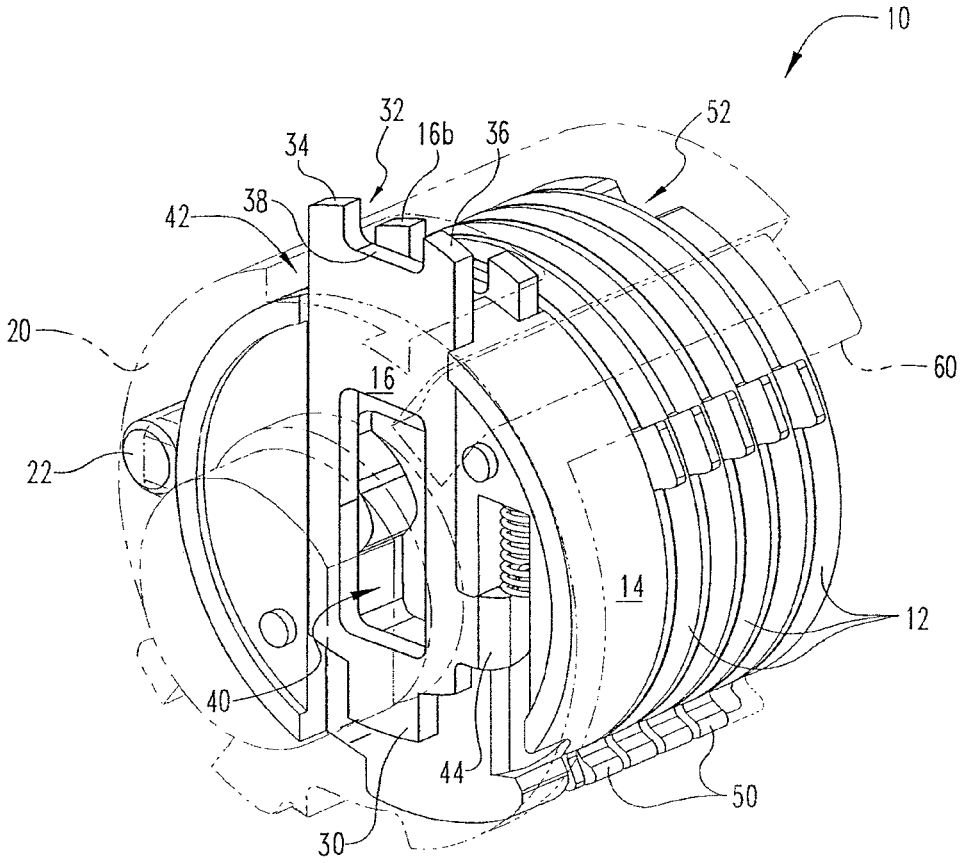
FIG. 2 is a perspective view of the lock cylinder of FIG. 1 with a wafer in a locked position.

Referring now to FIG. 2, the discs 12 can freely rotate relative to the spindle 20 when the lock cylinder 10 is in a locked position with external support structure. This cylinder orientation can be caused by using an incorrect key or lock picking tools when trying to open the lock cylinder 10. The cylinder orientation of FIG. 2 can also be a default orientation caused by biasing means when a correct key is not inserted into the cylinder 10. Each wafer 16 can include a single lock extension 30 formed on one end thereof and a dual leg lock extension 32 formed on the opposing end thereof in some embodiments of the present disclosure. Although not illustrated, in other embodiments of the present disclosure, the wafers 16 can include a single lock extension 30 formed on each of the opposing ends thereof. The dual leg lock extension 32 includes a first leg lock extension 34 on one side and a second leg lock extension 36 on the opposing side that forms a locking bar receiving region 38 therebetween. Each wafer housing 14 can also include a locking bar receiving region 39 (best seen in FIG. 3). A key slot 40 is formed in the central region of the wafer 16 and extends through each of the components of the lock cylinder 10. The key slot 40 is operable for receiving a key (not shown) that is configured to slidingly move the wafer 16 in a desired direction to unlock the wafer 16 relative to a structural support (not shown) and the spindle 20.

In the configuration shown in FIG. 2, the wafer 16 is in a locked orientation wherein the first leg lock extension 34 and second leg lock extension 36 extended through a spindle lock aperture 42 formed in the spindle 20 which restricts relative movement between the spindle 20 and the wafer housing 14. When the wafer 16 is in the locked configuration, the wafer housing 14 is mechanically locked to the spindle 20 and therefore, the wafer housing 14 cannot be rotated relative to the spindle 20. Furthermore, when the first leg lock extension 34 and second leg lock extension 36 is extended past the outer surface of the spindle 20 and into a support structure, it forms one of the locking elements of the lock cylinder 10. If the wafer 16 is biased in the other direction, either by way of a spring 18 or a key, the single lock extension 30 can extend through a spindle lock aperture at the other end of the spindle 20 and can further extend into static support structure (not shown) in a similar manner as the dual leg lock extension 32. In this manner, each wafer must be centrally aligned such that the lock extensions 30, 32 of the wafer 16 are positioned inside of the inner surface of the wafer housing 14 to be in an unlocked position. It should be noted that each wafer housing can include more than one wafer 16 and in this exemplary embodiment a second wafer 16*b* is shown for illustrative purposes.

Each disc 12 includes a disc locking bar receiving region 52 similar to the locking bar receiving regions 38 and 39 of the wafer 16 and wafer housing 14, respectively. When the locking bar receiving regions 38, 39 and 52 of the wafer 16, wafer housing 14 and discs 12, respectively, are aligned with the locking bar 22, the locking bar can move to the second position and the hybrid lock cylinder assembly 10 is in an unlocked configuration relative to an outer support structure. It should be noted that in some embodiments the wafers 16 do not include a locking bar receiving region 38 and in those embodiments the wafers 16 can be moved in such a way that the wafer 16 does not interfere with the movement of the locking bar 22. The locking bar 22 can be moved through gravitation and ramp means or alternatively can be moved via biasing means. Each disc can include a pawl 50 that extends outward to prevent rotation of an associated disc 12 past an abutment edge 60 formed on the spindle 20. Although not shown in the drawing, a second abutment edge can be formed on the spindle 20 to restrict rotational movement of the discs 12 in the other direction.

Figure 3:
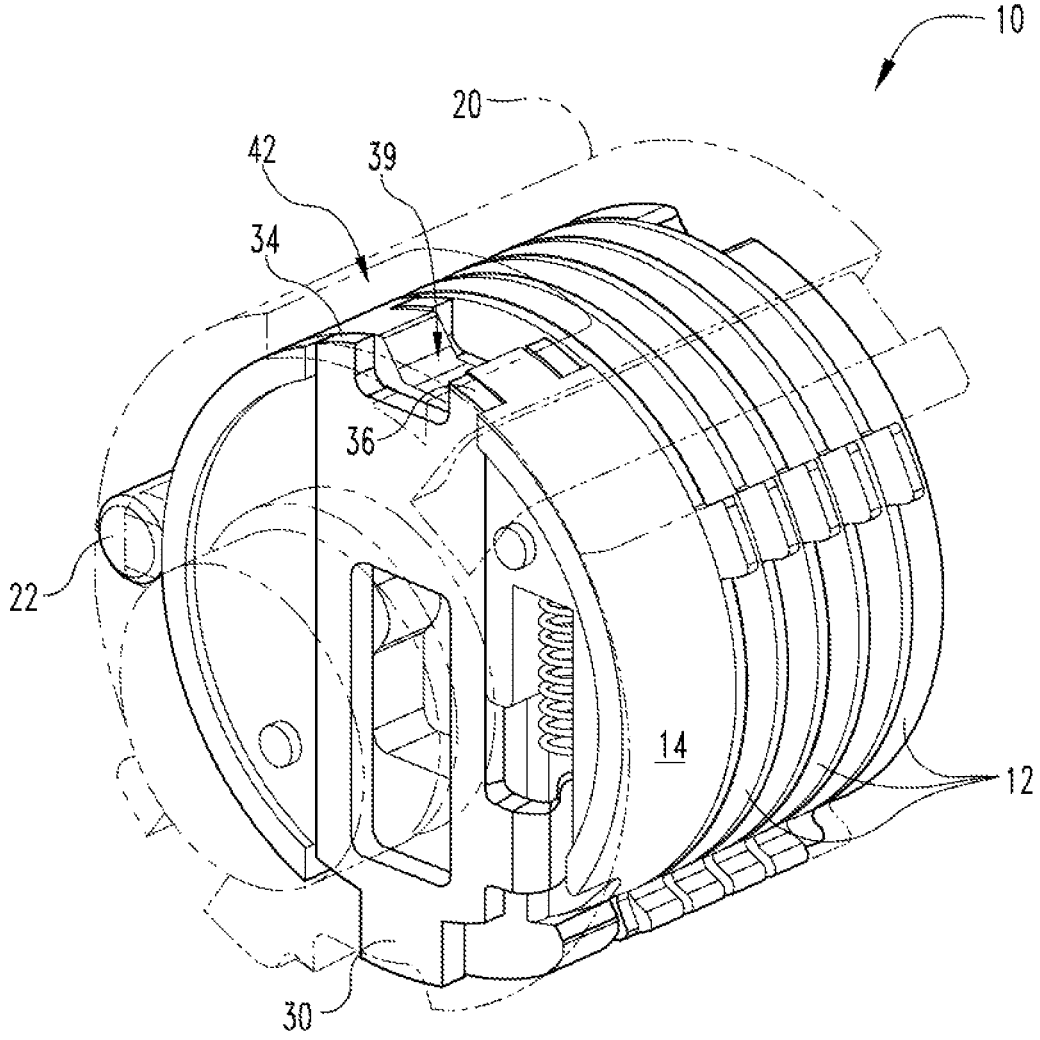
FIG. 3 is a perspective view of a lock cylinder of FIG. 1 with a wafer in an unlocked position.

Referring now to FIG. 3, the hybrid lock cylinder assembly 10 is shown wherein the wafer housing 14 is in an unlocked configuration with respect to the spindle 20. In this orientation, the discs 12 and the wafer housing 14 can rotate freely relative to the spindle 20. However, the spindle 20 is still locked to outer support structure (not shown) via the locking bar 22 that is positioned across the shear line between the support structure (not shown) and spindle 20 such that the locking bar prevents rotation of the spindle 20. The wafer 16 is moved via a key such that the first leg 34 and second leg 36 of the dual leg lock extension 32 on one end and the single lock extension 30 on the opposing end are positioned within the inner surface of the spindle 20 and thereby uncoupling the wafer housing 14 from the spindle 20.

Figure 4:
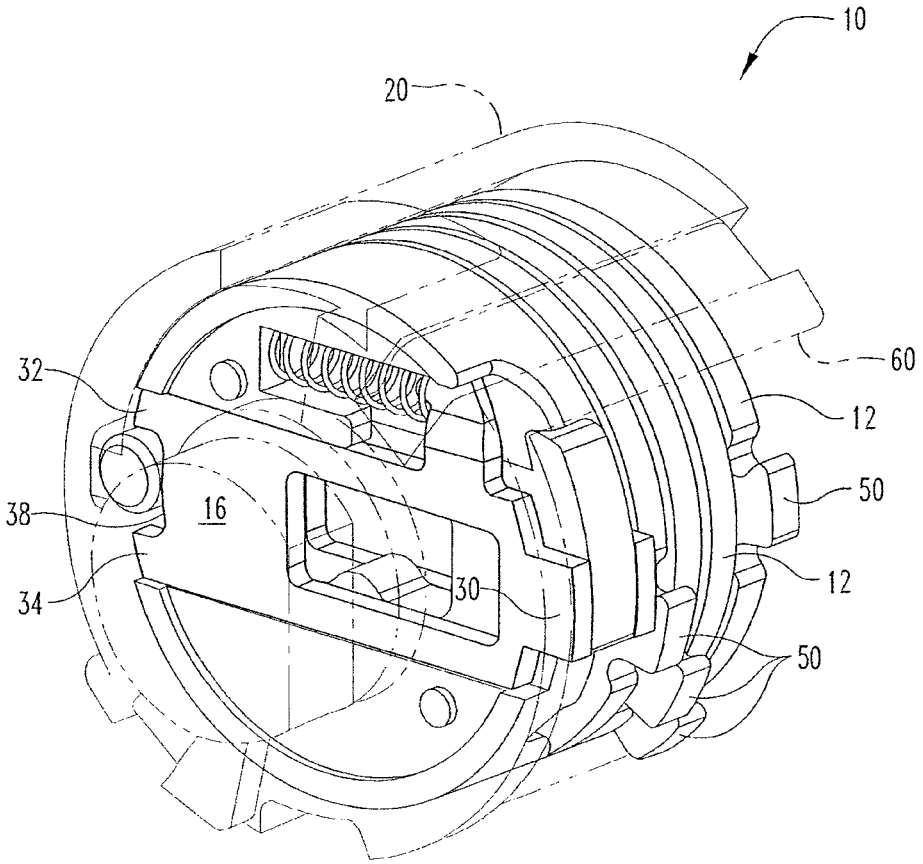
FIG. 4 is a perspective view of a lock cylinder of FIG. 1 wherein the cylinder is in an unlocked orientation.

Referring now to FIG. 4, the hybrid lock cylinder assembly 10 is shown in an unlocked configuration. The wafer 16 has been centered with a key so as not to extend into the spindle 20. The wafer housing 14 and discs 12 can then be rotated to the orientation shown in FIG. 4. In this position, the locking bar receiving region 38 of the dual leg lock extension 32 and the disc locking bar receiving region 52 (not shown in this view) are aligned with the locking bar 22 such that the locking bar 22 can move past the shear line between the spindle and the support structure (not shown) and into the shear line formed between the wafer housing 14, discs 12 and the outer spindle 20. The locking bar 22 can extend substantially across an entire length of the hybrid lock cylinder 10 in some embodiments. In other embodiments, the length of the locking bar 22 is less than the length of the hybrid lock cylinder 10. The cross sectional shape of the locking bar 22 can be any of a plurality of shapes such as square, triangular, polygonal or circular as illustrated. Regardless of the cross sectional shape and size of the locking bar 22, the locking bar receiving region 38 of the wafer 16, the locking bar receiving region 39 of each wafer housing 14 and the locking bar receiving region 52 of each disc must be shaped and sized to cooperatingly receive the locking bar 22 when the lock cylinder 10 is rotated to an unlocked position. In the configuration shown in FIG. 4, the discs 12, wafer housing 14 and spindle 20 are coupled together, but are free to rotate relative to a support structure (not shown). The pawls 50 of the discs 12 permit the discs 12 to be rotated until reaching an abutment edge (60) of the spindle 20.

Figure 5:
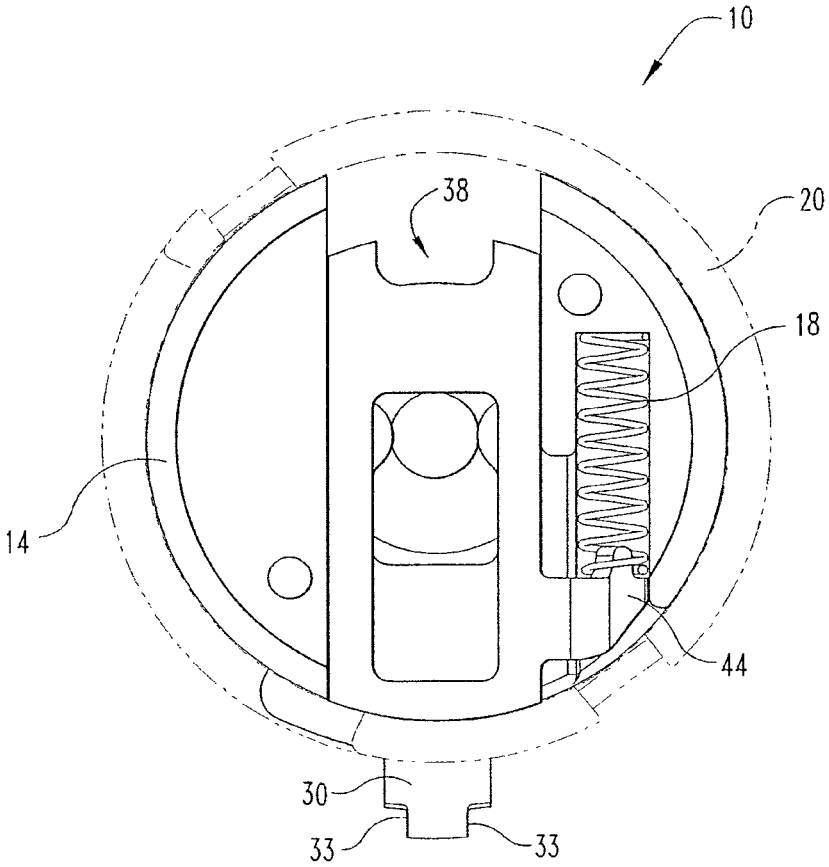
FIG. 5 is an end view of a lock cylinder according to an alternate embodiment of the present disclosure.

Referring now to FIG. 5, an end view of the hybrid lock cylinder assembly 10 is illustrated in an alternate embodiment. The wafer 16 includes a single lock extension 30 having at least one notch 33 formed on at least one side thereof. In this exemplary illustration, a pair of notches 33 are formed on either side of the lock extension 30. Each notch 33 acts as an antipick theft deterrent whereby when a lock picker moves the wafer 16 to a particular position, it will permit the wafer housing 14 to rotate slightly causing the lock picker to believe that the wafer 16 is in an unlocked orientation. The lock picker will then move to the next wafer or disc to continue to try to unlock each component of lock assembly 10. However, the notched 33 version of the single lock extension 30 will not permit complete rotation of wafer housing 14 such that the locking bar receiving regions 38 and 39 of the wafer and wafer housing respectively, cannot be placed into a position whereby the locking bar 22 can be moved therein and unlock the lock cylinder 10.

Figure 6:
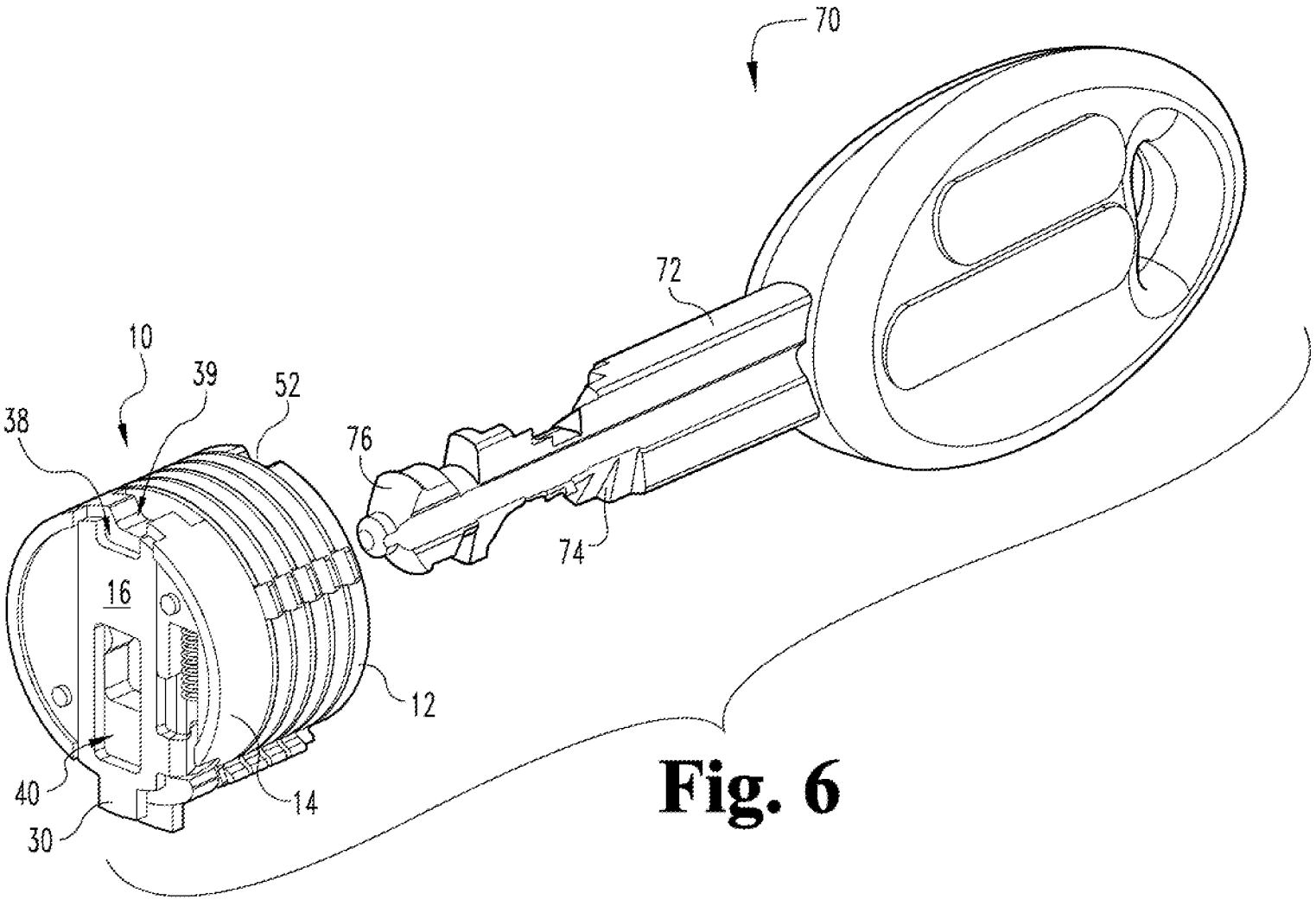
FIG. 6 is a perspective view of portion of the lock cylinder of FIG. 1 with a key configured to actuate the lock cylinder.

Referring now to FIG. 6, a portion of the hybrid lock cylinder assembly 10 is shown with a key 70 to illustrate operational principles of the present disclosure. The key 70 can be inserted through the key slot 40 such that the ramp portion 76 of the key 70 is configured to move one or more wafers 16 to an unlocked position in a sliding manner so that the wafer housing(s) 14 can be rotated relative to the spindle 20. The angled cuts 74 of the shank 72 are coded to coincide with each disc 12 so as to align the disc locking bar receiving regions 52 of each of the discs 12 (only one region is shown on the first disc). After aligning the disc locking bar receiving regions 52 by engaging the key 70 into the key slot and rotating the key, the discs 12 and the wafer housing(s) 14 can be rotated such that the locking bar receiving region 38 of the wafer 16, the wafer housing receiving region 39 and disc locking bar receiving regions 52 of the discs 12 are aligned. The wafer housing(s) 14 and discs 12 can be rotated together and the locking bar receiving regions 38, 39 and 52 can be positioned in direct alignment with the locking bar 22 (not shown in this drawing) such that the locking bar 22 can move into the locking bar receiving regions and thereby unlock the spindle 20 (not shown in this view) from a support structure. A lock member such as a common deadbolt or the like can be operably coupled with the spindle such that when the spindle is rotated the deadbolt is disengaged from a support structure.

Figure 7:
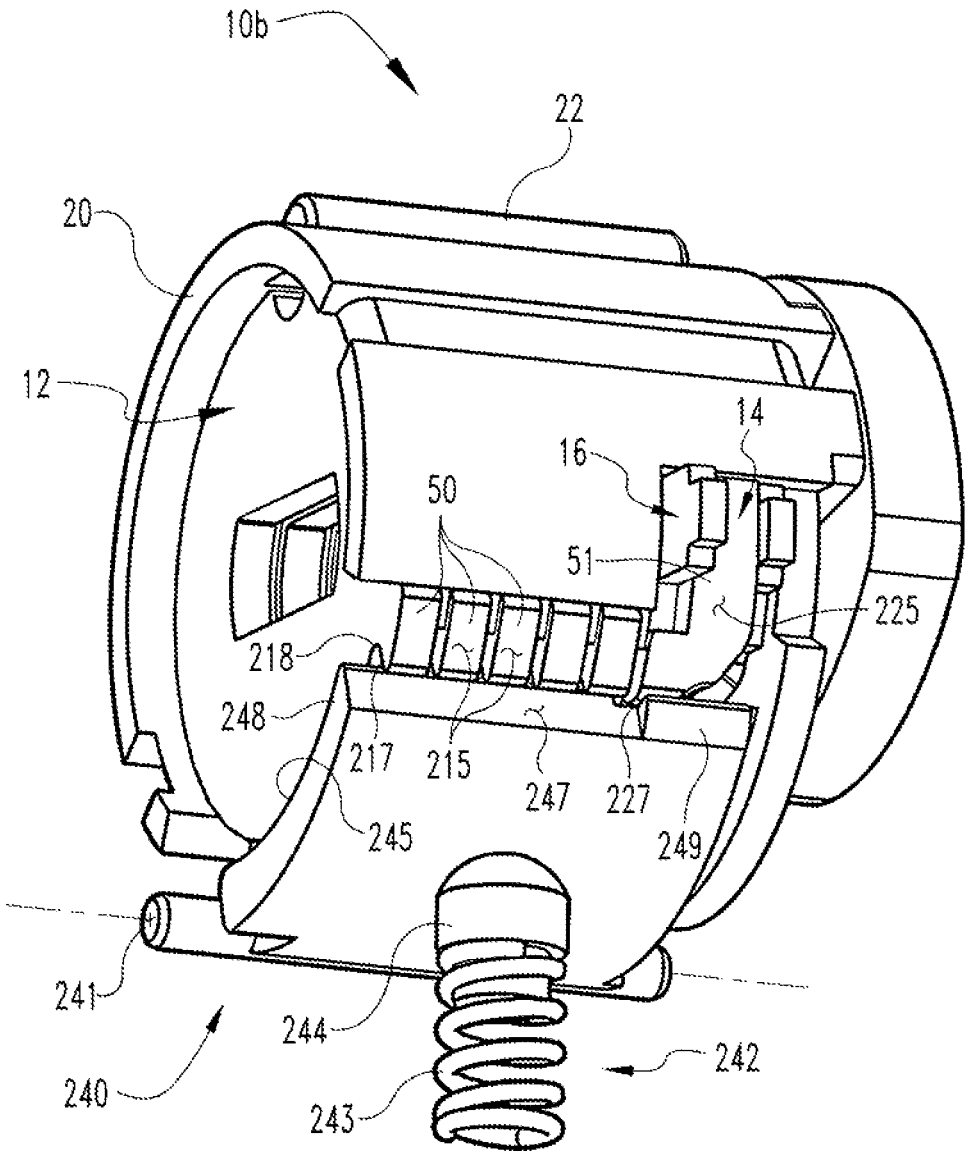
FIG. 7 is a perspective view of an alternate embodiment of the lock cylinder of FIG. 1.

With reference to FIG. 7, an alternate embodiment of the hybrid lock cylinder 10*b* is illustrated. According to one form of the disclosure, the lock cylinder 10*b* can include a movable catch 240, and a biasing mechanism 242 that exerts a biasing force against the movable catch 240 to engage the movable catch 240 against the discs 12. The movable catch 240 can pivot about a pivot hinge 241 from a first position to a second position. The movable catch 240 can engage with pawls 50 of the discs 12 so as to prevent the discs 12 from rotating when the catch 240 is in the first position. A pawl 51 of the wafer housing 14 can actuate or move the moveable catch 240 to the second pivot position and thereby release the discs 12.

In the illustrated embodiment, the catch 240 rotates about the pivot hinge 241 that may be arranged generally parallel with the axial centerline A (see FIG. 1), and is biased toward the first position via the biasing mechanism 242. The pivot hinge 241 may be maintained in a stationary position with respect to the outer support structure (not shown), and may be coupled thereto. In the illustrated embodiment, the biasing mechanism 242 includes a biasing member 243 which exerts a biasing force onto the catch 240 through a connection or bearing member 244. The bearing member 244 may be integral with, attached to, or positioned in contact with the catch 240. In some embodiments, the biasing member 243 may directly engage the catch 240, thereby eliminating the bearing member 244. In the illustrated embodiment, the catch 240 is constrained to pivotal movement. However, in other embodiments, the catch 240 may additionally or alternatively be movable in another direction.

The catch 240 may extend generally parallel to the axial centerline A, and includes an arcuate inner bearing surface 245, an interference contact surface 247 that terminates at a tip portion 248, and an extended distal portion 249. The inner bearing surface 245 is configured to be displaced along the outer surfaces 215, 225 of the pawls 50, 51 respectively, once the catch 240 has been moved away from and out of the first position. In the illustrated embodiment, the inner bearing surface 245 is of a constant arc radius that generally corresponds to the outer arc radius of the outer surfaces 215, 225 of the pawls 50, 51. It is also contemplated that the inner bearing surface 245 may have a varying arc radius, for example, if the outer surfaces 215, 225 of the pawls 50, 51 do not define a substantially uniform outer arc radius.

As should be appreciated, the interference surface 247 of the catch 240 is configured to prevent rotation of the discs 12 about the axial centerline A when the catch 240 is in the first position. In the first position, the interference surface 247 of the catch 240 is generally radially aligned with the interference surfaces 217 of the discs 12, thereby blocking the rotational travel path of the pawls 50 and preventing rotation of the discs 12. Because the discs 12 cannot rotate, they will remain in an aligned position. If a user attempts to rotate one or more of the discs 12, the interference surface 247 will engage the interference surface 217, thereby preventing rotation of the disc. By maintaining the discs 12 in the aligned position until a proper key is fully inserted into the keyway of the hybrid lock cylinder 10*b*, the hybrid lock cylinder 10*b* not only alerts the user when the key is not fully inserted, but also obviates the need for a user to turn the key back and forth in order to realign the discs.

To reduce internal stresses resulting from a user applying excessive force to the key when the catch 240 is in the first position, it is desirable to increase the area of contact between the interference surfaces 217 and 247. To this end, the pawls 50 and the catch 240 may be configured such that interference surfaces 217, 247 are substantially parallel to one another when they are positioned in contact with one another. Additionally, in the illustrated embodiment, each disc 12 is configured such that when the catch 240 is in the first position, the tip portion 248 is positioned at least partially within the hooked recesses 218 of the discs 12, thereby increasing the area of contact between interference surfaces 217, 247. It is also contemplated that the hooked recess 218 may be absent in one or more of discs 12, in which case the tip portion 248 may contact a circumferential surface of the disc 12.

The extension 249 of the catch 240 is generally aligned in the axial direction with the wafer housing 14, and is configured to interact with the pawl 51 of the wafer housing 14. While the extension 249 extends beyond the interference surface 247 substantially only along the curved arc defined by the catch 240, it is also contemplated that an extension may extend in a direction toward the pawl 51. When the wafer housing 14 is rotated, the contact bearing surface 227 urges the extension 249 away from the axial centerline A, thereby pivotally displacing the catch 240 away from and out of the first position.

When the outer surface 225 of the wafer housing 14 contacts the inner surface 245 of the catch 240, the catch 240 will be positioned in the second position, wherein the interference surface 247 is no longer radially aligned with the interference surfaces 217 of the discs 12, and the discs 12 are thereby free to rotate about the axial centerline A. When the catch 240 is positioned in the second position, the biasing mechanism 242 continues to exert a biasing force onto the catch 240. This biasing force causes the inner bearing surface 245 to exert a radially inward force onto the outer surfaces 215, 225 of the pawls 50, 51, thereby resulting in a corresponding frictional force which resists rotation of the discs 12, and wafer housing 14 about the axial centerline A. This frictional force continues to resist rotation of the discs 12, and wafer housing 14, even when the locking bar receiving regions 38, 39 and 52 of the wafer 16, wafer housing 14 and discs 12, respectively, are aligned with the locking bar. The added frictional force increases the difficulty of sensing a change in resistive force, making it much more difficult for a person attempting to pick the lock to determine when the discs are in the proper position for unlocking of the hybrid lock cylinder 10*b*.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A hybrid lock cylinder comprising:

a spindle having an axis of rotation;

a wafer housing positioned within the spindle and having a locking bar receiving portion, the wafer housing configured to rotate about the axis of rotation;

a wafer with lock extensions formed on opposing ends thereof being slidably carried by the wafer housing;

at least one disc configured to rotate about the axis of rotation positioned adjacent the wafer housing;

a locking bar receiving portion formed in the wafer, the wafer housing and each disc; and a locking bar movable relative to the locking bar receiving portion of the wafer, the wafer housing and each disc.

2. The hybrid lock cylinder of claim 1, wherein at least one of the lock extensions of the wafer includes a single protruding extension.

3. The hybrid lock cylinder of claim 2, wherein the single protruding extension of the at least one of the lock extensions of the wafer includes at least one notch formed in one side thereof.

4. The hybrid lock cylinder of claim 1, wherein one of the lock extensions of the wafer includes a pair of protruding extensions with the locking bar receiving portion formed therebetween.

5. The hybrid lock cylinder of claim 1 further comprising: a biasing member coupled between the wafer and the wafer housing.

6. The hybrid lock cylinder of claim 1 further comprising: a wafer channel with first and second ends formed in the wafer housing to provide a guide path for the wafer to slide therein.

7. The hybrid lock cylinder of claim 6, wherein a biasing member urges the wafer toward one end of the wafer channel.

8. The hybrid lock cylinder of claim 6, wherein one of the opposing lock extensions of the wafer extends into an orifice formed in the spindle and prevents the wafer housing from rotating relative to the spindle when the wafer is positioned proximate either of the first and second ends of the wafer channel.

9. The hybrid lock cylinder of claim 1, further comprising another of the wafer housing positioned within the spindle, and another of the wafer carried by the another of the wafer housing; and wherein the lock extensions on the wafer are of different lengths relative to lock extensions on the another of the wafer.

10. The hybrid lock cylinder of claim 1, wherein each disc is free to rotate relative to the spindle in a locked configuration.

11. The hybrid lock cylinder of claim 1, wherein the spindle includes at least one abutment edge.

12. The hybrid lock cylinder of claim 11, wherein each disc includes a pawl extending therefrom to engage with the at least one abutment edge.

13. The hybrid lock cylinder of claim 1, wherein a single key is operable to position an angular orientation of each disc and a radial location of the lock extensions of the wafer.

14. The hybrid lock cylinder of claim 1, wherein the spindle includes shaped apertures for receiving the lock extensions of the wafer.

15. The hybrid lock cylinder of claim 1, further comprising a support structure, and wherein the locking bar prevents rotation of the spindle relative to the support structure in a locked position.

16. The hybrid lock cylinder of claim 1, wherein the spindle is rotatable when the locking bar is moved to the locking bar receiving portions of each disc, the wafer and the wafer housing.

17. The hybrid lock cylinder of claim 1 further comprising: a moveable catch pivotally connected to a pivot hinge, the movable catch having a first position and a second position.

18. The hybrid lock cylinder of claim 17, wherein the moveable catch prevents rotation of each disc in the first position and permits rotation of each disc in the second position.

19. The hybrid lock cylinder of claim 18, wherein a portion of the wafer housing is engagable with the moveable catch and is operable to move the moveable catch into the second position when the wafer housing is rotated to a predefined location.

20. The hybrid lock cylinder of claim 18 further comprising: a biasing member operable to urge the moveable catch toward the first position.

21. A method for unlocking a hybrid cylinder comprising:

inserting a key into a keyway of the cylinder;

rotating, with the key, a plurality of discs such that a locking bar receiving region of each disc is aligned with one another;

sliding, with the key, a lock extension of at least one wafer out of engagement with a spindle;

rotating, with the key, the plurality of discs and at least one wafer housing relative to the spindle until a locking bar is aligned with and moves into a locking bar receiving region formed in each wafer housing and each disc;

rotating, with the key, the spindle, the discs and the at last one wafer housing after the locking bar is moved to a shear plane between the spindle and the discs and the at least one wafer housing; and rotating, with the key, the spindle, discs, and each wafer housing to unlock the hybrid cylinder.

22. The method of claim 21 further comprising: sliding, with the key, a lock extension of at least one wafer out of engagement with an adjacent structure.

23. The method of claim 21 further comprising: rotating, with the key, a plurality of discs and at least one wafer housing relative to the spindle until the locking bar is aligned with and moves into a locking bar receiving region formed in a wafer.

24. An apparatus comprising:

a rotatable spindle adapted to be releasably lockable to an outer support structure;

a rotatable wafer housing positioned within the spindle and releasably lockable to the spindle with a slidable wafer;

at least one rotatable disc being free to rotate relative to the spindle when the spindle is releasable locked to the outer support structure; and a movable locking bar operable to prevent rotation of the spindle in a first position and permit rotation of the spindle in a second position.

25. The apparatus of claim 24, wherein the locking bar extends across a shear line between the spindle and the support structure in the first position and is positioned radially inward from the shear line of the spindle and the support structure in the second position.

26. The apparatus of claim 24 further comprising: a coded key configured to disengage at least one lock extension of a wafer from the spindle, align locking bar receiving regions of each disc, and rotate the wafer housing and each disc such that locking bar receiving regions formed in the wafer housing and each disc are aligned to receive the locking bar.

* * * * *